US007284398B2

(12) United States Patent
Hübner

(10) Patent No.: US 7,284,398 B2
(45) Date of Patent: Oct. 23, 2007

(54) MULTILAYERED, BREATHABLE TEXTILE FABRIC

(75) Inventor: Sonja Hübner, Zeil (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 104 days.

(21) Appl. No.: 10/526,681

(22) PCT Filed: Oct. 21, 2003

(86) PCT No.: PCT/US03/33701

§ 371 (c)(1),
(2), (4) Date: Jun. 22, 2005

(87) PCT Pub. No.: WO2004/037027

PCT Pub. Date: May 6, 2004

(65) Prior Publication Data

US 2006/0042326 A1 Mar. 2, 2006

(30) Foreign Application Priority Data

Oct. 21, 2002 (DE) ..... 102 48 999

(51) Int. Cl.
*D04B 23/06* (2006.01)

(52) U.S. Cl. ..... 66/192; 66/202

(58) Field of Classification Search ..... 66/202, 66/196, 169 R, 170, 171
See application file for complete search history.

(56) References Cited

U.S. PATENT DOCUMENTS

| | | | | |
|---|---|---|---|---|
| 3,272,685 | A | 9/1966 | Kagan | |
| 4,755,407 | A * | 7/1988 | Mortensen et al. | 428/34.5 |
| 4,980,228 | A * | 12/1990 | LaMarca et al. | 442/222 |
| 5,136,723 | A * | 8/1992 | Aldridge et al. | 2/81 |
| 5,236,769 | A * | 8/1993 | Paire | 428/196 |
| 6,430,745 | B2 * | 8/2002 | Murai | 2/19 |
| 7,013,496 | B2 * | 3/2006 | Dunn | 2/458 |

FOREIGN PATENT DOCUMENTS

| | | | |
|---|---|---|---|
| DE | 43 07 501 | A1 | 10/1993 |
| DE | 195 47 704 | A1 | 6/1997 |
| EP | 0 724 848 | A | 8/1996 |
| WO | WO 96/08174 | A | 3/1996 |
| WO | WO 02/18126 | A | 3/2002 |

* cited by examiner

*Primary Examiner*—Danny Worrell

(57) ABSTRACT

The present invention relates to a multilayered, breathable fabric and especially, but not exclusively, to a textile fabric for clothing purposes. In a special embodiment, the invention relates to a fabric for manufacturing articles of work clothing for protection against the effects of heat, flames or arcing and the like. Therefore, the invention also relates to an article of fire protection clothing with a novel, breathable, moisture-transporting fabric as the inner layer. However, the textile fabric can also be used in the leisure sector, for example, to manufacture functional undergarments.

17 Claims, 2 Drawing Sheets

MULTILAYERED, BREATHABLE TEXTILE FABRIC

BACKGROUND OF THE INVENTION

1. Field of the Invention

The present invention relates to a multilayered, breathable—that is to say, moisture vapor permeable—textile (including woven and knitted) fabric and especially, but not exclusively, to a textile fabric for clothing purposes. In a special embodiment, the invention relates to a fabric for manufacturing articles of work clothing for protection against the effects of heat, flames, electric arc, and the like. Therefore, the invention also relates to an article of fire protection clothing with a novel, breathable, moisture-transporting fabric as an inner layer. However, the textile fabric can also be used in the leisure sector, for example, to manufacture functional undergarments.

2. Description of Related Art

The state of the art already describes "breathing" fabric constructions such as, those sold under the name GORE-TEX®. Breathable fabrics are essentially water impermeable on one side, while they allow water vapor to escape through the fabric on the other side. These fabrics are used for articles of clothing, especially for jackets and coats and pants. Here, the fabric is waterproof, while, at the same time, it prevents the collection of water vapor under the coat caused by perspiration. U.S. Pat. No. 3,272,685 describes a waterproof fabric that has at least two different layers.

German Patent DE 195 47 704 A1 describes a multilayered textile fabric consisting of two fabric layers with different denier values used to transport perspiration and other bodily fluids. The fabric layers have a material from the group consisting of polyester, nylon and acrylic resin. This fabric, however, is not suitable for manufacturing protective clothing.

German Patent DE 43 07 501 A1 describes a multilayered textile fabric with an inner layer of microfibers, whereby the fabric has a wicking or capillary effect and improves the water vapor transport from the inside to the outside. The described textile fabrics are used to manufacture sports clothing, leisure clothing and the like.

As a rule, protective clothing, for instance, for firefighters, is very heavy on its own. The protective outfits provide protection by being massive, but this greatly limits the wearer's ability to move and leads to severe heat stress, thus considerably impairing the wearing comfort.

Moreover, it has to be taken into consideration that fire protection clothing has to meet national standards, for example, the standards DIN EN 469 or SN 054551.

As explained above, it has been found that so far, due to the lack of perspiration transport out of the inner protective outfit, the persons in question, that is to say, firefighters, are very well protected against hazards from the outside, but the wearing comfort, in spite of the multilayered structure, is not optimal from a physiological standpoint. Moreover, a large accumulation of moisture on the skin is very dangerous in case of fire since severe burns are to be feared here as a result of the steam being generated.

Therefore, in the area of protective clothing for firefighters, there has long been a need to find materials that combine a protective function, flame retardation, as well as thermal insulation and greater wearing comfort through facilitated perspiration transport, without storing the moisture in the fiber.

Consequently, it is the objective of the invention to provide a novel multilayered, breathable fabric that can be used for manufacturing articles of clothing, especially fire protection clothing.

BRIEF SUMMARY OF THE INVENTION

This objective is achieved by multilayered, breathable textile fabric 1 for articles of clothing with enhanced wearing comfort owing to easy moisture transport, characterized in that the textile fabric 1 comprises at least two separate layers 2, 3 that are bonded to each other by means of dots or lines or else over the entire surface, whose warp and weft yarns consist of aramid yarns or aramid twisted threads or aramid filament yarns or yarns made of blended fibers containing polybenzimidazole and aramid fibers, whereby the layers 2, 3 have different individual fiber degrees of fineness in order to bring about a fineness gradient over the thickness 7 of the fabric 1, whereby the side 6 of the layer 3 that essentially faces the skin has the coarser individual fiber titer and the layer of the side 4 facing away from the skin has the finer individual fiber titer.

DETAILED DESCRIPTION OF THE INVENTION

Figure 1:
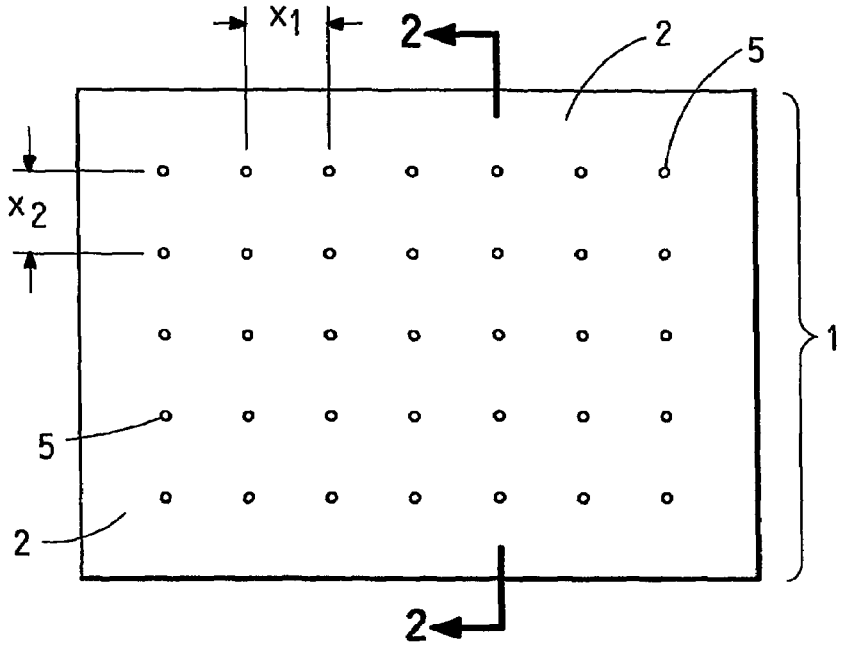
FIG. 1 is a top view of the multilayered fabric 1 according to the invention with the side 6 facing the skin.

Through the intelligent structuring of the textile fabric, a good insulating effect is achieved with a relatively low square meter weight. Furthermore, the perspiration generated by the wearers is immediately transported to the side facing away from the skin (wicking effect) so that the wearer no longer experiences any feeling of wetness and no moisture can accumulate.

In comparison to the well-established reference material according to the state of the art, namely, aramid lining material, the fabric according to the invention, while providing virtually identical thermal insulation, has a moisture absorption, relative to the square meter weight, that is about four to eight times as high in comparison to the prior art material. The time within which the drops of perspiration are absorbed is less than one second with the material according to the invention. With the conventional material, that is to say, with aramid lining material, this value is about five minutes.

The mode of action of the textile fabric 1 according to the invention can be described as follows. The fabric 1 is composed of at least two separate single plies 2, 3 being bonded to each other at predefined positions 5 by the mean of selected bounding yarns which are part of the ply 3 which faces away from the skin. The bounding yarns are woven or knitted or stitched through the ply 2 on the skin side. The bounding yarns are visible on this predefined position on the skin side 6 in the form of dots.

The moisture formed on the skin is absorbed by the microfiber composing the bounding yarns forming the dots 5 located on the skin side 6, it is then transported by the capillary action of the microfibers along the bounding yarns to the back of the ply or layer 3 by means of capillary action and the preferred direction of the bounding yarns towards the ply 3 facing away from the skin. On the side 6 which faces the skin it quickly evaporates due to the large surface of the waffle structure. Consequently, the side 6, which faces the skin, always remains relatively dry in comparison to normal material, for example, normal aramid lining fabric.

According to a preferred embodiment of the present invention, the multilayered, breathable textile fabric 1 is used to manufacture an article of work clothing, for example, for firefighters. The textile fabric 1 consists of a base fabric, ply or layer 2 and a microfiber fabric, ply or layer 3, each layer 2,3 with warp and weft yarns.

The warp and weft yarns for each of the layers 2,3 can be made of aramid spun yarn (made from staple fiber) as well as multifilament continuous yarn can be used. Combinations are also possible. According to the invention, however, it is also possible to use phenol formaldehyde fibers, polyamide/polyimide fibers, polybenzimidazole fibers or fiber mixtures made of the above-mentioned fibers or else fiber mixtures with aramid yarns or else blended fibers containing polybenzimidazole and aramid fibers.

If the fabric 1 according to the invention is to be used in the leisure sector, there is, of course, no longer a need to use aramid yarn. In this case, polyester and/or polyamide yarns can then used for either or both of the layers 2,3. Such materials are fundamentally known to the person skilled in the art.

According to the invention, the aramid yarns consist of aramid fibers from the group made up of Nomex®, Kevlar®, Twaron®, Technora®, and Teijinconex®. Products such as Kynol® are used as the phenol formaldehyde fibers and products such as Kermel® are used as the polyamide/polyimide fibers.

Possible weaves are all basic woven or knit types of weaves and their variations.

The aramid fibers are natural colored or dyed.

According to the invention, the fabric layers 2, 3 have a square meter weight in the range from 50 to 450 g/m$^2$.

Figure 2:
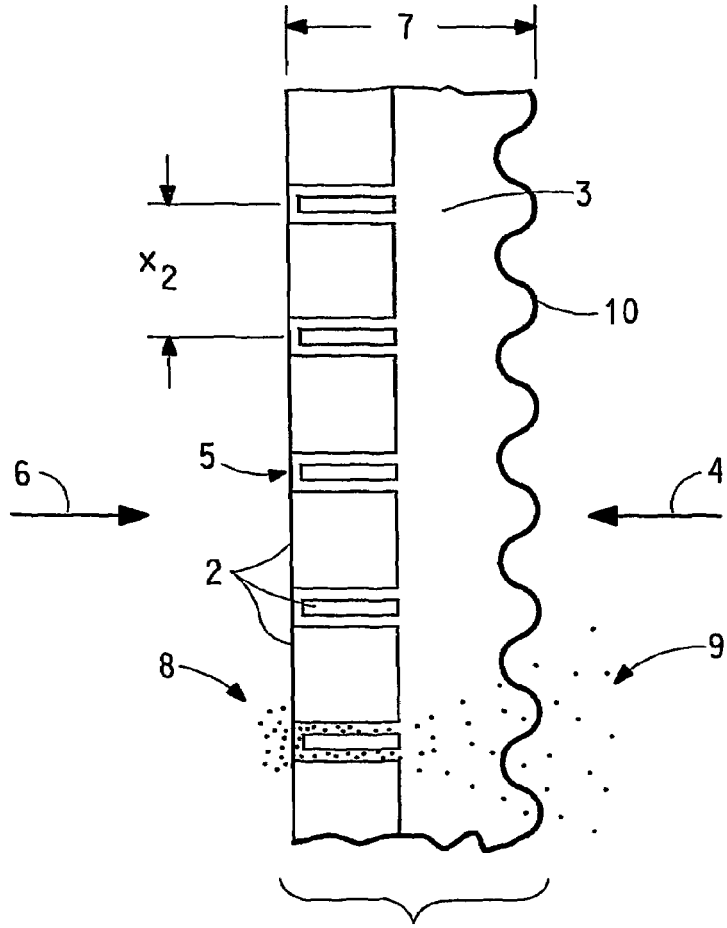
FIG. 2 is a section through the multilayered fabric 1 according to the invention of FIG. 1 along Line 2-2.
Figure 3A:
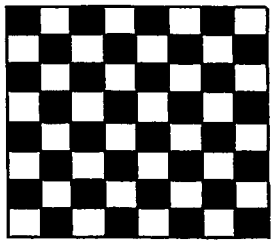
FIG. 3*a* is a mechanical illustration of a repeating portion of a plain weave pattern of an embodiment of a dobble weave fabric 1 used in the Example viewed toward skin side 6.
Figure 3B:
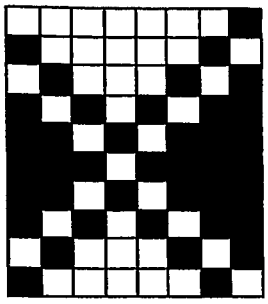
FIG. 3*b* is a mechanical illustration of a repeating unit of the fabric 1 of FIG. 3*a* viewed from side 4.
Figure 3C:
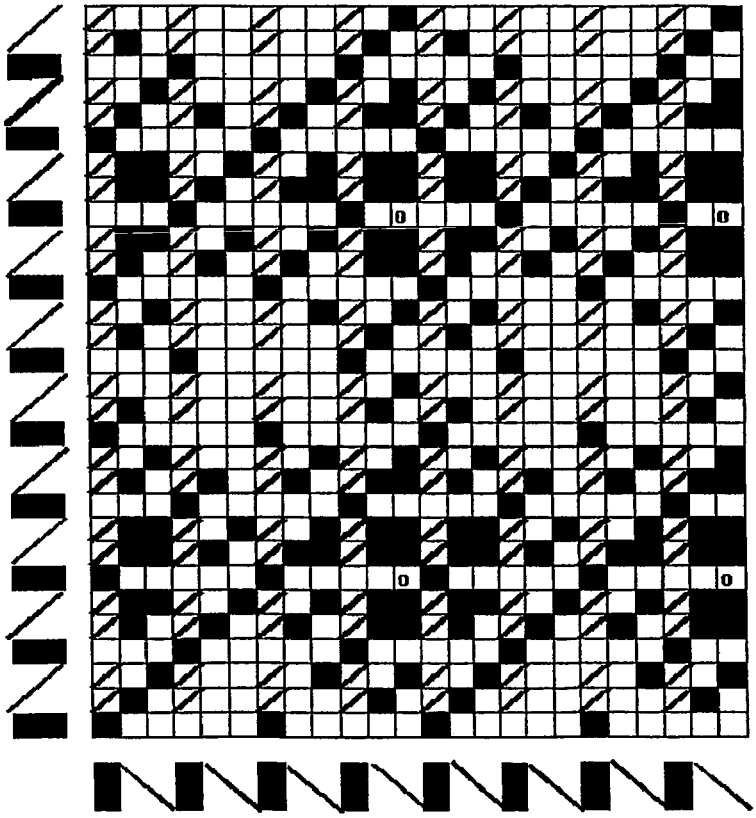
FIG. 3*c* is a symbolic weaver design of the fabric 1 of FIGS. 3*a* and 3*b*.
Figure 3D:
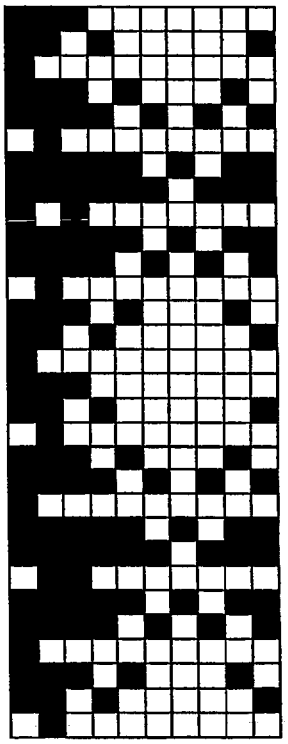
FIG. 3*d* is a loom harness lifting plan for the symbolic design in FIG. 3*c* where each column corresponds to a separate harness.

According to the invention, in a preferred embodiment, the breathable fabric 1 is a duplex construction comprising at least two layers or plies 2, 3 that are bonded to each other. The layers 2, 3 are bonded to each other by means of selected bounding yarns which are part of the ply 3 which faces away from the skin forming dots 5 or lines or else over the entire surface, whereby in one embodiment, the pattern shown in FIG. 1 can be formed. The individual microfiber dots 5 are each at a distance of $x_1$ in the weft direction and $x_2$ in the warp direction from each other as indicated in the FIG. 1. The distances $x_1$ and $x_2$ should be selected in such a way that a water micro droplet on the surface 6 of the layer 2 facing the skin would touch at least one of the dots 5 or lines. The base fabric or layer 2 according to the invention consists fundamentally of a basic woven or knit base fabric, whereby the layers 2, 3 have different individual fiber deniers, i.e., degrees of fineness of the individual fibers, in order to bring about a fineness gradient over the thickness 7 of the fabric 1. According to the invention, however, the finer denier layer 3 is on the outside, that is to say, on the side 4 facing away from the skin. In particular, this layer 3 has individual fiber titers of less than 1.3 dtex, especially less than 1 dtex. Preferably, the microfiber layer 3 has a highly structured surface 10. The fibers used in the layer 3 are microfibers, i.e., a new generation of ultrafine-titer fibers. With these microfiber yarns, one can manufacture very windproof, fine-pored, water-repellant fabrics that have a soft hand but that are good at dissipating water vapor or moisture of a perspiring person. This effect is shown in FIG. 2. Perspiration 8 formed on the skin is picked up via the microfiber dots 5 and transported to the outside by the capillary action of the bounding yarns of the fabric 3 (wicking effect 9). This wicking effect 9 is necessary for the transport of moisture 8 (perspiration, condensation water) from the inside 6 to the outside 4.

In one embodiment, the textile fabric 1 can be used in a fire-protection jacket. The textile fabric 1 or insulating lining can be in a composite with other materials. For example, an article can be made comprising:

(A) an outer layer or shell alone or as a 2-layered or 3-layered laminate;

(B) an intermediate water barrier layer: laminate with or without a backing layer; and (C) an inner fabric 1: Fritsche "Function" (according to the invention), e.g., 95% Nomex®, 5% Kevlar®, mixed with 100% aramid microfiber, square meter weight ranging from 100 to 350 g/m$^2$, especially 280 g/m$^2$, width ranging from 100 to 200 cm, especially 160 cm; Yarn fineness, warp and weft: Nomex® III, Paris blue Nm 40/2 for layer 2 of fabric 1 and meta-aramid microfiber natural white Nm 80/2 for layer 3 of fabric 1; and weave type for fabric 1: fabric: special double-face (layer) weave, especially Sonja 0203 pattern.

LIST OF REFERENCE NUMERALS

1 textile fabric according to the invention "Fritsche Function"
2 base fabric, ply or layer
3 microfiber ply or layer with an individual fiber titer under 1.3 dtex
4 side or surface of layer 3 facing away from the skin
5 microfiber dot made of microfiber bounding yarn from or of layer 3
6 side or surface of layer 2 facing the skin
7 thickness of the fabric 1
8 moisture (perspiration, condensation, vapor, water)
9 wicking effect
10 highly structured surface of microfiber layer 3
$x_1$ distance between the microfiber dots in weft direction
$x_2$ distance between the microfiber dots in warp direction

EXAMPLE

A blend of fibers, commercially available from E. I. du Pont de Nemours and Company, Wilmington, Del., U.S.A., under the trade name Nomex® N301, having a cut length of 5 cm and consisting of:

95 wt % of pigmented poly-metaphenylene isophthalamide (meta-aramid), 1.7 dtex staple fibers; and 5 wt % of poly-paraphenylene terephthalamide (para-aramid) fibers, was ring spun into a single staple yarn (Y1) using conventional cotton staple processing equipment.

Y1 had a linear density of Nm 40/1 or 250 dtex and a twist of 700 Turns Per Meter (TPM) in Z direction and it was subsequently treated with steam to stabilize its tendency to wrinkle. Two Y1 yarns were then plied and twisted together. The resulting plied and twisted yarn (TY1) had a linear density of Nm 40/2 or 500 dtex and a twist of 500 TPM in S direction. TY1 was used as warp yarn and weft yarn for the ply or base fabric 2 facing the skin.

A fiber commercially available from E. I. du Pont de Nemours and Company, Wilmington, Del., U.S.A., under the trade name Nomex® T 450, having a cut length of 5 cm and consisting of 100% of poly-metaphenylene isophthalamide (meta-aramid), 1.1 dtex staple fibers, was ring spun into a single staple yarn (Y2) using conventional cotton staple processing equipment.

Y2 had a linear density of Nm 80/1 or 125 dtex and a twist of 1070 Turns Per Meter (TPM) in Z direction and it was subsequently treated with steam to stabilize its tendency to wrinkle. Two Y2 yarns were then plied and twisted together. The resulting plied and twisted yarn (TY2) had a linear density of Nm 80/2 or 250 dtex and a twist of 750 TPM in S direction. TY2 was used as warp yarn and weft yarn for the ply 3 facing away from the skin. TY2 were also used as the bounding yarns between the two plies as they have the highest capillarity.

TY1 and TY2 were woven into a special double-face weave according to Sonja 0203 pattern as illustrated in FIGS. 3*a-d*.

This fabric 1 was tested as an innerliner thermal barrier used in a multi layer structure (Garment in Table I) which further comprised (1) an intermediate water barrier layer of a polytetrafluoroethylene (PTFE) membrane laminate on a non-woven fabric made of 85 wt-% Nomex® and 15 wt-% Kevlar® and having a specific weight of 135 g/m$^2$ (commercially available under the trade name GORETEX® Fireblocker N from the company W. L. Gore and Associates, Delaware, U.S.A), and (2) an outershell having a specific weight of 195 g/m$^2$ and composed of a blend of fibers, commercially available from E. I du Pont de Nemours and Company, Wilmington, Del., U.S.A. under the trade name Nomex® N305 having a cut length of 5 cm and consisting of:

(1) 75% pigmented pigmented poly-metaphenylene isophthalamide (meta-aramid) 1.7 dtex staple fibers;

(2) 23% poly-paraphenylene terephthalamide (para-aramid) fibers; and (3) 2% of carbon core polyamide sheath antistatic fibers.

This fabric combination was tested against a combination of radiant and convective heat according to the thermal protection performance (TPP) method (ISO-FDIS 17492) ASTM D-4108 (NFPA 1971).

TABLE 1

| Description of assembly | Time to record pain (sec) | 2nd degree burn (sec) | TPP rating (cal/m$^2$) | Fabric Failure Factor |
|---|---|---|---|---|
| Sample 7 (3 layers) | 9.8 | 16.0 | 32.0 | 5.4 |
| Outershell 195 (g/m$^2$) | 9.5 | 15.7 | 31.4 | 5.3 |
| Water Barrier 135 (g/m$^2$) | 9.5 | 15.8 | 31.6 | 5.3 |
| Innerliner/Thermal Barrier 265 (g/m$^2$) | avg: 9.6 | avg: 15.8 | avg: 31.7 | avg: 5.3 |
| Total effective wt: 595 (g/m$^2$) | | | | |

Fabric Failure Factor (FFF) is defined by 100 times the TPP rating (being the energy in (cal/cm$^2$) measured to simulate a second-degree burn) divided by the fabric weight in g/m$^2$. FFF=100×TPP/fabric weight.

The FFF was 5.3 compared to the prior art or benchmark which is between 5.2 and 6.7.

This FFF of 5.3 shows that the fabric of this Example can be used in thermal protective garments.

This fabric 1 was also tested according to a water transmission test with a water drop of 60 ml applied with a syringe on the fabric 1. The test consisted of measuring the time for the penetration and absorption. This test was repeated for the ply 2 facing the skin alone without the second ply 3 and the bounding yarns. Results are in Table 2.

TABLE 2

| Sample | Test | Time for penetration |
|---|---|---|
| Ply facing the skin alone | Drop 1 | 2 sec. |
| | Drop 2 | 5 sec. |
| | Drop 3 | 3 sec. |
| | Drop 4 | 7 sec. |
| | Drop 5 | 3 sec. |
| Average | | 4 sec. |
| Fabric according to the invention | Drop 1 | immediate |
| | Drop 2 | immediate |
| | Drop 3 | immediate |
| | Drop 4 | immediate |
| | Drop 5 | immediate |
| Average | | immediate |
| Control fabric Nomex ® comfort Quilted with Felt 250 g/m2 | Drop 1 | 6 sec. |
| | Drop 2 | 7 sec. |
| | Drop 3 | 7 sec. |
| | Drop 4 | 6 sec. |
| | Drop 5 | 8 sec. |
| Average | | 7 sec. |

This test shows that the ply facing the skin without the use of the invention is not better than a standard fabric. This test therefore confirms that the invention is dependent on the effect of the dots composed by the bounding yarns by means of capillary action and the preferred direction of the bounding yarns towards the ply facing the skin.

This fabric 1 was tested according to a water absorption test method. The test consisted of applying a colored water drop of 20 ml on the ply of the fabric facing the skin fabric and measured after 60 seconds the size of the drop on the each layer of the sample. Results are in Tables 3 and 4.

TABLE 3

| Fabric according to the invention Ply facing the skin Test | Size in mm |
|---|---|
| Drop 1 | 6 |
| Drop 2 | 6 |
| Drop 3 | 6 |
| Average | 6 |

TABLE 4

| | Test | Minimum Size in mm after penetration | Maximum size in mm after penetration |
|---|---|---|---|
| Ply facing away from the skin | Drop 1 | 25 | 33 |
| | Drop 2 | 27 | 35 |
| | Drop 3 | 26 | 38 |
| Control Nomex ® comfort Quilted with Felt 250 g/m2 | Drop 1 | 0 | 0 |
| | Drop 2 | 0 | 0 |
| | Drop 3 | 0 | 0 |

This test demonstrates the capacity of the fabric to diffuse the water on the ply facing away from the skin. Consequently, the ply which faces the skin, always remains relatively dry in comparison to normal material, like the control aramid lining fabric quilted with felt 250 g/m$^2$.

The fabric 1 was tested against moisture absorption on porous disk method STFI-Vorschr. PE03 from the Sächsisches Textil Forschung Institute, simulating the physiological properties of a fabric in contact with a wet skin. The moisture absorption was measured in g/dm$^2$, and the relative moisture absorption was calculated according the fabric surface weight. The fabric 1 was also tested against the sweating guarded hot plate test ISO-11092 in order to obtain the Ret value. This fabric was compared with a control Fritsche 48101330022941 composed of a Nomex® Comfort liner of 140 g/m$^2$ quilted with a Nomex® knitted thermal barrier of 190 g/m$^2$. The results are in Table 5.

TABLE 5

| | Ret (M$^2$Pa/W) | Absolute moisture absorption (g/dm$^2$) | Relative moisture absorption (%) |
|---|---|---|---|
| Fabric 1 Function | 5.78 | 7.7 | 255 |
| Control Fritsche 48101330022941 | 6.86 | 2.4 | 67.5 |

These results are demonstrating that the fabric has a moisture absorption, relative to the square meter weight, that is about four times as high in comparison to the prior art material. These are good results and they show that the fabric 1 will easily pick up the moisture away from the skin of the wearer. The Ret value of 5.78 is rated as very good (<6 very good, 6-13 good, 13-20 sufficient, >20 insufficient) and demonstrates that this fabric 1 is very breathable.

This fabric 1 was tested according to the contact heat resistance test in accordance with prEN 702. The threshold time $t_x$(sec) at 100° C. was measured at 19.8 sec and was significantly better than a standard fabric out of Nomex® N 307 having $t_x$(sec) at 100° C. value of 18.4 sec.

The articles of clothing according to the invention can be made up as desired.

The fabric according to the invention is, of course, not limited to the use for manufacturing protective clothing. In particular, the fabric can be used to manufacture leisure clothing, especially to manufacture functional undergarments.

What is claimed is:

1. Multilayered, breathable textile fabric (1) for articles of clothing with enhanced wearing comfort owing to easy moisture transport, characterized in that the textile fabric (1) comprises at least two separate layers (2,3), the layer (2) having a skin side (6); the layer (3) having an outside (4), the two separate layers being bonded to each other at predefined positions (5) by means of selected bounding yarns which are part of the layer (3), the bounding yarns being woven or knitted or stitched through the layer (2) on the skin side, whose warp and weft yarns consist of aramid yarns or aramid twisted threads or aramid filament yarns or yarns made of blended fibers containing polybenzimidazole and aramid fibers, whereby the layers (2,3) have different individual fiber degrees of fineness in order to bring about a fineness gradient over a thickness (7) of the fabric (1), whereby the skin side (6) of the layer (2) has a the coarser individual fiber titer and the layer of the outside side (4) has the finer individual fiber titer.

2. The textile fabric according to claim 1, characterized in that the layer (2) is a woven, a knitted fabric or a warp knitted fabric.

3. The textile fabric according to claim 1, characterized in that the second layer (3) is a woven, a knitted fabric or a warp knitted fabric.

4. The textile fabric according to claim 1, 2 or 3, characterized in that all of the layers (2,3) have a structure exhibiting at least two different individual fiber finenesses.

5. The textile fabric according to claim 1, characterized in that it is a duplex construction with two layers bonded to each other.

6. The textile fabric according to claim 1, characterized in that the layer (2) as well as the layer (3) are visible on the skin side (6).

7. The textile fabric according to claim 1, characterized in that the re-drying time of the skin side (6) is optimally shortened by the combination of extremely fine fibers and a large surface area of the article.

8. The textile fabric according to claim 1, characterized in that the two layers (2,3) are bonded to each other by a double-face weave, by a double-face knit or by a double-face warp knit.

9. The textile fabric according to claim 1, characterized in that the layers (2,3) have a square meter weight in the range from 50 g/m2 to 450 g/m2, whereby the square meter weight of the individual layers can be identical or different.

10. The textile fabric according to claim 1, characterized in that the layer (3) has an individual fiber titer of less than 1.3 dtex.

11. The textile fabric according to claim 1, characterized in that the warp yarns comprise multifilament aramid yarns or multifilament aramid twisted yarns or aramid filament yarns and the weft yarns alternately comprise multifilament aramid yarns or multifilament aramid twisted yarns or aramid filament yarns.

12. The textile fabric according to claim 1 or 11, characterized in that the multifilament aramid yarns or multifilament aramid twisted threads or aramid filament yarns present in the weft yarns are similar or identical to one of the two alternately arranged, different multifilament yarns or multifilament twisted threads or aramid filament yarns that form the warp yarns.

13. The textile fabric according to claim 1, characterized in that the aramid yarn contains fibers that are selected from the group consisting of poly-m-phenylene isophthalamide fibers, poly-p-phenylene terephthalamide fibers or mixtures of poly-m-phenylene isophthalamide and poly-p-phenylene terephthalamide fibers.

14. An article of clothing, characterized by a structure consisting of at least one two-layered textile composite having an inner layer and an outer layer, whereby the multilayered, breathable textile fabric according to claim 1 forms the inner layer.

15. An article of work clothing for protection against the effects of heat, flames or electric arc and having a textile cover layer made of high-temperature-resistant fibers, characterized by a structure made up of at least a two-layered textile composite having an inner layer and an outer layer consisting of a textile material made of high-temperature-resistant fibers, whereby the inner layer contains a multilayered, breathable textile fabric according to claim 1.

16. The article of work clothing according to claim 15, characterized in that it is a fireproof jacket or fireproof pants.

17. The article according to claim 14 or 15, further comprising a middle layer made of polyester or polyamide or aramid microfiber fabric.

* * * * *